United States Patent [19]

Gentile et al.

[11] Patent Number: 4,852,224

[45] Date of Patent: Aug. 1, 1989

[54] ORNAMENTAL Z-SHAPED ROTARY FASTENING DEVICE

[75] Inventors: John J. Gentile; Anthony R. Gentile, both of New York; Christopher T. Gentile, Nyack, all of N.Y.

[73] Assignee: Abrams/Gentile Entertainment Inc., New York, N.Y.

[21] Appl. No.: 155,315

[22] Filed: Feb. 12, 1988

[51] Int. Cl.[4] ..... A44B 21/00; A44C 13/00

[52] U.S. Cl. ..... 24/590; 63/29.1

[58] Field of Search ..... 24/590, 580; 63/9, 29.1, 63/30; 411/349, 549, 553; 206/566, 486, 45.13, 45.14

[56] References Cited

U.S. PATENT DOCUMENTS

| | | | |
|---|---|---|---|
| 267,851 | 11/1882 | Engelmann | 63/9 |
| 1,102,055 | 6/1914 | Kenney | 24/590 |
| 1,148,444 | 7/1915 | Crawford | 24/590 |
| 2,209,714 | 7/1940 | Chernow | 63/29.1 |
| 2,281,455 | 4/1942 | Powell | 411/549 |
| 2,291,975 | 8/1942 | Minero | 24/590 |
| 2,620,539 | 12/1952 | Poupitch | 411/349 |
| 2,693,014 | 11/1954 | Monahan | 24/590 |
| 2,714,754 | 8/1955 | Knohl | 411/553 |
| 3,242,690 | 3/1966 | Kettell | 63/29.1 |
| 3,273,766 | 9/1966 | Cosentino | 63/29.1 |
| 3,407,454 | 10/1968 | Myatt | 411/549 |
| 3,743,147 | 7/1973 | Wilczynski | 24/590 |
| 3,937,319 | 2/1976 | Roy | 206/566 |
| 4,599,768 | 7/1986 | Doyle et al. | 24/590 |

FOREIGN PATENT DOCUMENTS

| | | | |
|---|---|---|---|
| 588886 | 6/1947 | United Kingdom | 411/549 |

*Primary Examiner*—Victor N. Sakran

*Attorney, Agent, or Firm*—Kenyon & Kenyon

[57] ABSTRACT

A fastening device that secures containers or ornaments to bracelets or other items of jewelry, and other items used by children such as belts, hair clips, lunch boxes, pouches, mirrors, jewelry boxes and the like is disclosed. The fastening device comprises a holding member having a shank, one end of the shank being fixed to the first object and the other end of the shank having a Z-shaped flange extending therefrom and an attaching member having a Z-shaped opening complementary to the Z-shaped flange such that the Z-shaped opening fits over the Z-shaped flange. When the attaching member is rotated on the Z-shaped flange, the attaching member is secured to the holding member thereby securing a second object to the first object.

5 Claims, 2 Drawing Sheets

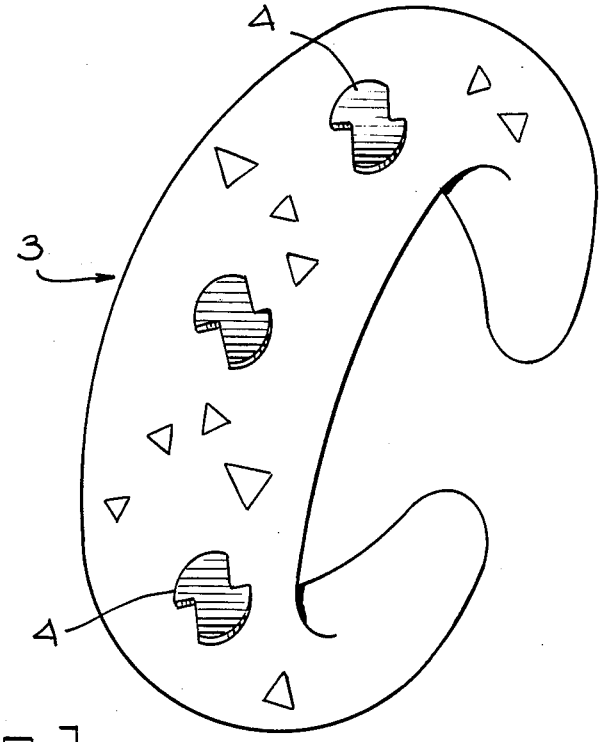
Fig. 1.
Fig. 2.
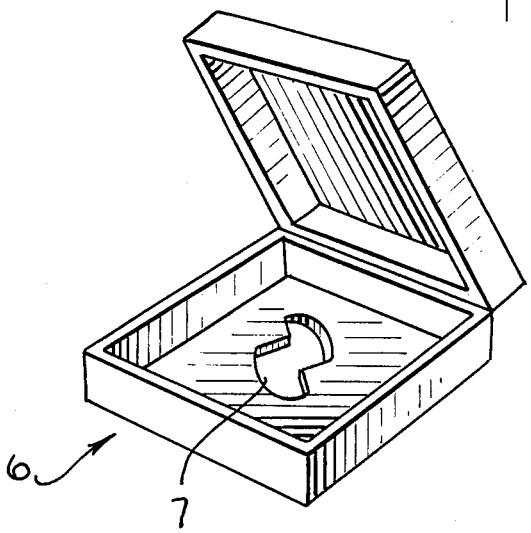

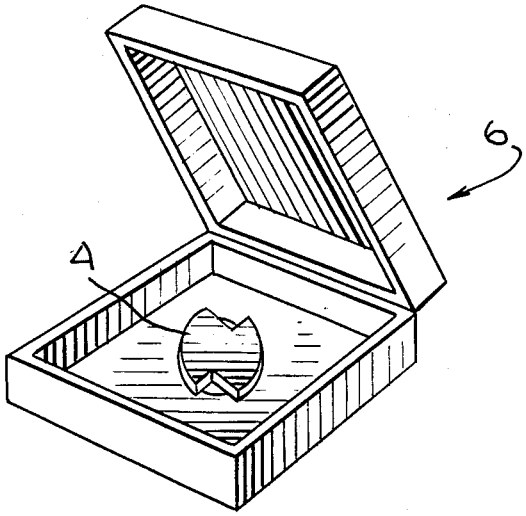
Fig. 3.
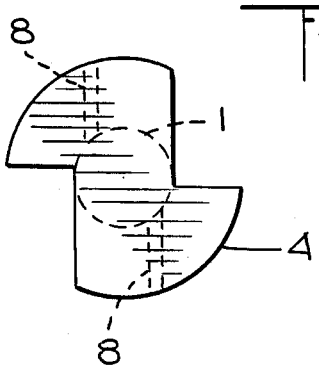
Fig. 4.
Fig. 5.
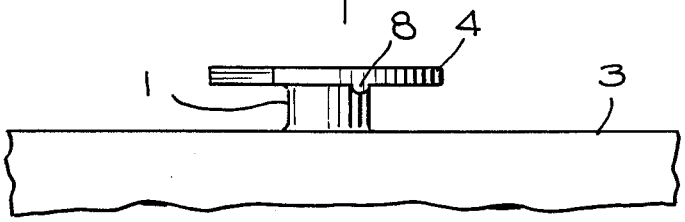

ORNAMENTAL Z-SHAPED ROTARY FASTENING DEVICE

BACKGROUND OF THE INVENTION

This invention relates to fastening devices and more particularly to fastening devices that secure containers or ornaments to bracelets, other items of jewelry, and other items used by children such as belts, hairclips, lunch boxes, pouches, mirrors, jewelry boxes and the like.

Various devices that combine a container or ornament with bracelets or other objects are known in the art. For example, Engelmann (267,851) discloses a bracelet with a box container which attaches to the bracelet by vertically projecting side plates extended below the bottom of the box and beveled to fit upon the base plate of the bracelet. Kettell (U.S. Pat. No. 3,242,690) discloses an ornament mounting to a channel bracelet whereby the ornament having a member positioned in the channel is rotated to permanently lock the ornament in the channel. Costentino (U.S. Pat. No. 3,273,766) discloses a bracelet with article retainers, which attach by screwing down a threaded member. Crawford (U.S. Pat No. 1,148,444) discloses a unidirectional dress fastener and Powell (U.S. Pat. No. 2,281,455) discloses a spring assisted fastener.

Each of these devices has limited usefulness and adaptability to use by children. For example, all of the fasteners or objects can be turned in only one direction to engage and disengage the members. Most of these devices are not suitable for fabrication of plastic which could fragment under the stress required to attach the members. All of the disclosed devices are difficult for children to operate, requiring force and dexterity. None of these devices is decorative when the members are unattached, and some are unattractive when separated. For example, the bracelet in Englemann's patent reveals joints, springs, and plates when a case is not attached to cover these functional parts of the bracelet. Further, in Kettell's patent for example, the ornaments are permanently attached after connecting to the bracelet.

SUMMARY OF THE INVENTION

An object of the present invention is to provide a fastening device that releasably secures containers or ornaments onto objects such as bracelets, boxes, vanities and other such items used by children and can be operated quickly and easily by children.

The invention uniquely overcomes the difficulty and limitation in releasably attaching two members where connecting parts of members correspond to each other in a single orientation only. Here, because of the unique Z-shaped configuration, the members can be attached in two orientations.

In this invention, one member of the fastening device has a Z-shaped flange projecting above the surface of the object to which it is fixed. Such flange has symmetrical legs which enables the member to be attached at two locations. Such symmetrical legs are arcuate, an especially easy shape for children to fit into an opening of complementary shape.

In addition, the member to be attached to the decorative Z-shaped flange can be rotated clockwise or counter-clockwise, a feature contributing to the ease of attachment and disengagement by children, eliminating a need for them to remember the direction in which the attaching member should be rotated.

Another unique feature is the simple but reliable mechanism by which children temporarily can secure the two members together. In this invention, a projection on one member engages a depression on the other member whereby the two members are connected and secured until a child further rotates the attaching member, pushing the projection out of the depression, disengaging the two members. Projections or depressions can be located on either member with a corresponding projection or depression on the other member.

Another unique feature of this invention is the attractiveness of the Z-shaped flange when no objects are attached to it. Alone it is ornamental and pleasing to the eye when fixed to various surfaces. A number of visually appealing Z-flanges in a variety of different colors can be fixed to a surface in a random placement or in a pattern.

The attaching member can also be attractive, being configured in a variety of shapes having assorted colors, color combinations, patterns and textures.

A further object of this invention is to provide a means for children to carry personal accessories including cosmetics without carrying a bag or other container in the hands. Toward this end, the attaching member can be a container which can be preset with cosmetics such as eye shadow and rouge and their applicators. In such an embodiment, the wearer can select specific cosmetics according to the shape and color of the container.

Containers can also be empty to accommodate children's personal items such as tools, coins, marbles, and other objects, hidden from sight and leaving children's hands free. A wide range of other attachable objects and ornaments may also be utilized.

BRIEF DESCRIPTION OF THE DRAWINGS

With these objects in view, the invention consists of the novel features of construction and arrangement of parts which will appear in the following specification and recited in the appended claims, reference being had to the accompanying drawings in which the same reference numerals indicate the same parts throughout the various figures and in which:

FIG. 1 is an object (bracelet) having shanks and Z-shaped flanges.

FIG. 2 is an object with a Z-shaped opening designed to receive a Z-shaped flange.

FIG. 3 is a Z-shaped flange engaged in a Z-shaped opening in an object.

FIG. 4 is a top view of the lower surface of the Z-shaped flange showing a projection.

FIG. 5 is a cross section of the long axis of the flange shown in FIG. 4

DESCRIPTION OF THE PREFERRED EMBODIMENT

In general, the invention is particularly, though not exclusively, adaptable for use in attaching containers or ornaments to jewelry or other items worn or used by young girls. It is to be understood that the term "jewelry" used herein is employed to denote any of the wide variety of items worn or used by young girls, including bracelets, rings, belts, hair clips, mirrors, jewelry boxes, vanities and other articles used as accessories for ornamentation and utility. Those in the art will appreciate that the present invention is adaptable to any of a number of such items. Solely for convenience, the following discussion is addressed to one preferred embodiment of the invention shown in FIG. 1, a bracelet which is worn on a wrist to which is attached a container which holds make-up.

The fastener illustrated comprises two members, one of which is a holding member (FIGS. 4 and 5) and the other of which is an attaching member (6). As shown in FIGS. 4 and 5, the holding member consists of shank (1), which is cylindrical in form and is permanently affixed to bracelet (3) at one end. The other end of shank (1) terminates in Z-shaped flange (4). As shown in FIG. 2, attaching member (6) consists of a container in which there is a Z-shaped opening (7) corresponding to and slightly larger than that of Z-shaped flange (4).

The holding member (FIGS. 4 and 5) is fixed, by glueing for example, to an object, bracelet (3) for example, such that one end of shank (1) is fixed to the outer surface of bracelet (3) and the other end is integrally attached to Z-shaped flange (4). When attaching member (6) is coupled with bracelet (3), attaching member (6) is aligned and turned relative to the holding member (FIGS. 4 and 5) so that the major axis of Z-shaped opening (7) of attaching member (6) is parallel to that of Z-shaped flange (4) of the holding member. The opening (7) is then pressed onto Z-shaped flange (4), receiving the extension of shank (1). To secure attaching member (6) on the holding member (FIGS. 4 and 5), attaching member (6) is rotated until rotation is stopped by at least one projection (8) on the lower surface of Z-flange (4) engaging a depression (not shown) in the upper surface of Z-shaped opening (7) or vice versa. The members are shown engaged in FIG. 3. To disengage the container from the bracelet, the fastening can be undone by bringing the major axis of the Z-shaped flange parallel to the Z-shaped opening and uncoupling the two.

Those in the art will understand that variations from the embodiment discussed herein can be made within the ambit of the invention. For example. the shape and size of the attaching member wherein lies the opening may be changed. Further the attaching member may be a container hinged at the top or at another location, in which items can be placed, or may be a solid ornament. The object on which the holding member is mounted may be a bracelet or any of the many other items earlier described and may be made of plastic, wood, or other material and may be changed to some other type of jewelry or a multitude of various base units. These and other changes can be made without departing from the scope of the invention which is defined by the claims appended hereto.

We claim:

1. A fastening device for coupling a first and second object such that said objects can be attached and disengaged with out the need for the user to have to remember the direction in which the objects should be rotated comprising:

a holding member having a shank, one end of said shank being fixed to said first object and the other end of said shank having a Z-shaped flange extending therefrom; and an attaching member having a Z-shaped opening complementary to said Z-shaped flange such that said Z-shaped opening fits over said Z-shaped flange and when rotated both clockwise and counterclockwise releasably secures said attaching member to said holding member thereby securing said second object to said first object, said attaching member being releasable by rotating both clockwise and counterclockwise.

2. The fastening device of claim 1 where said Z-shaped flange and opening have two legs having arcuate surfaces.

3.The fastening device of claim 1 which further includes at least one projecting member on the lower surface of the flange and at least one depression on the upper surface surrounding the opening such that the projecting member will engage the depression when the opening is placed over the flange and rotated both clockwise and counterclockwise.

4. The fastening device of claim 1 which further includes at least one depression on the lower surface of the flange and at least one projecting member on the upper surface surrounding the opening, such that the projecting member will engage the depression when the opening is placed over the flange and rotated both clockwise and counterclockwise.

5. A bracelet made of first and second objects such that said objects can be attached and disengaged with out the need for the user to have to remember the direction in which the objects should be rotated comprising:

a band to wear on the wrist;

at least one Z-shaped flange projecting from a shank fixed to the outer surface of said band; and at least one container having a Z-shaped opening, rotatably both clockwise and counterclockwise secured to the Z-Shaped flange, releasably securing said container to the bracelet.

* * * * *